United States Patent [19]

Bisping et al.

[11] Patent Number: 4,708,064

[45] Date of Patent: Nov. 24, 1987

[54] IMPACT PROJECTILE

[75] Inventors: Bernhard Bisping, Ratingen-Hösel; Klaus Gersbach, Willich; Rudolf Romer, Kaarst, all of Fed. Rep. of Germany

[73] Assignee: Rheinmetall GmbH, Dusseldorf, Fed. Rep. of Germany

[21] Appl. No.: 412,794

[22] Filed: Aug. 23, 1982

Related U.S. Application Data

[63] Continuation of Ser. No. 949,067, Sep. 5, 1978, abandoned.

[30] Foreign Application Priority Data

Sep. 29, 1977 [DE] Fed. Rep. of Germany ..... 2743732

[51] Int. Cl.[4] ..... F42B 11/00

[52] U.S. Cl. ..... 102/517; 102/521

[58] Field of Search ..... 102/501, 506, 489, 491–495, 102/507–510, 514–519, 703, 520–523

[56] References Cited

U.S. PATENT DOCUMENTS

| | | | |
|---|---|---|---|
| 644,361 | 2/1900 | Luciani . | |
| 1,312,762 | 8/1919 | Strang . | |
| 1,312,763 | 8/1919 | Strang . | |
| 2,304,152 | 12/1942 | Darden | 102/519 |
| 3,213,792 | 10/1965 | Grenander . | |
| 3,545,383 | 12/1970 | Lucy | 102/518 |
| 3,877,380 | 4/1975 | Riparbelli . | |
| 3,916,795 | 11/1975 | Lemstra . | |
| 3,981,246 | 9/1976 | Luther et al. . | |
| 4,108,072 | 8/1978 | Trinks | 102/518 |
| 4,123,975 | 11/1978 | Mohaupt | 102/518 |

FOREIGN PATENT DOCUMENTS

| | | |
|---|---|---|
| 198658 | 12/1951 | Austria . |
| 1194292 | 1/1966 | Fed. Rep. of Germany . |
| 1428679 | 9/1977 | Fed. Rep. of Germany . |
| 128248 | 6/1919 | United Kingdom . |
| 579205 | 7/1946 | United Kingdom . |
| 941524 | 11/1963 | United Kingdom . |
| 1303797 | 1/1973 | United Kingdom . |

*Primary Examiner*—Harold J. Tudor

*Attorney, Agent, or Firm*—Karl F. Ross; Herbert Dubno

[57] ABSTRACT

An armor piercing breaking projectile using a stack of prepenetrating partial cores with interfitting centering bosses and respective cutting edges for piercing successive layers of armor.

5 Claims, 8 Drawing Figures

IMPACT PROJECTILE

This is a continuation of application Ser. No. 949,067, filed 5 Sept. 1978, now abandoned.

FIELD OF THE INVENTION

The invention relates to inertial projectiles of hard metals comprised of a main core and an auxiliary core provided ahead of the main core and which, with the main core, is wholly or partially surrounded by a casing.

BACKGROUND OF THE INVENTION

Modern armored vehicles are of late equipped with platen-like and/or lamella-like armored walls which consequently form multiple targets and structured targets against which the prior, even high velocity subcaliber projectiles, have only a comparatively poor penetration.

To improve the penetration against multiple targets and structured targets, a projectile has been made known from German Pat. No. 1,194,292, whose thick-walled projectile casing surrounds a main core which is so subdivided transversely that the forward end of the main core forms a hemisphere whose diameter corresponds to that of the following cylindrical main core. The hemisphere is seated swingably in a conical or spherical recess at the end of a core-carrying part housed in the projectile tip and fabricated from heavy metal.

The projectile is designed to impact with an inclined attack angle upon the outer armoring whereby the forward part of the core-carrying part receives a torque about its center of gravity so that not only the latter itself penetrates perpendicular to the outer armoring, but also the same swinging movement is imparted to the two-part core. To facilitate the pivotal movement between core-carrying part and core, the thick-walled casing in the region of their separating joint is weakened in cross section by indentations.

The forward end of the core, which is spherically shaped for the purpose of the pivotal connection, must form a projectile unit with the following main core since the penetration of the armor by the ball-shaped leading surface alone is not possible but requires the mass of the following main core. The ball-shaped leading surface of the known projectile has poor penetration.

OBJECT OF THE INVENTION

The present invention has as its object to obviate the above mentioned disadvantages and to so improve an inertial projectile that with a small impact angle against multiple targets and structured targets it has an optimum penetration.

SUMMARY OF THE INVENTION

This object is achieved according to the invention in that the inertial projectile is formed entirely or partially of a stack of partial cores and all of the cores are provided with cutting edges turned toward the impact surface and with centering and/or fixing means between one another, with which they are easily separable from one another and replaceably connected.

A further feature of the invention resides in that the inertial projectile comprises a stack of forecores accommodated in the forward projectile half and a main core occupying the rearward projectile half, whereby main core and forecores are formed of cylindrical equal-diameter bodies with planar separating surfaces and sharp-edged cutting edges which limit glancing-off upon inclined impact.

Still another feature of the invention resides in that both because of the forecores and their comparatively releasable connections to one another and also because of the selection of the material, the impact shock is largely absorbed in the stack.

The forecores, corresponding to the target to be attacked, with respect to the size, number and material from which they are fabricated are individually or as the entire stack, exchangeable.

According to the invention, the forecores and, in case required, the main core, are connected together by centering means and fixing means comprised of a thin-walled and comparatively soft casing.

Suitable as separating means, according to another feature, are comparatively thin and easily rupturable pins. Further, the forecores can be connected together by comparatively stable central pins whose peripheral sharp edges form, with respect to the main cutting edges, further cutting edges which limit glancing from the target surface.

Further centering means are constituted from slightly formed outwardly lying collars, with or without threads.

Finally, the forecores can be connected together by a fastening screw which has, in the region of the forecore separations, easily rupturable preset breaking zones.

The centering means are provided with such fits or tolerances that they can be easily separated from one another for the purpose of replacing the cores. However it can be advantageous and this is another feature of the invention - that by different-tolerance fits of the centering and fixing means, the lateral sliding forces which are effective upon the cores upon a weak impact, in accordance with the different target objectives, give rise to a controlled core-by-core dismantling of the stack.

BRIEF DESCRIPTION OF THE DRAWING

The invention is further described in conjunction with the accompanying drawing with respect to several embodiments. In the drawing.

SPECIFIC DESCRIPTION

Figure 1:
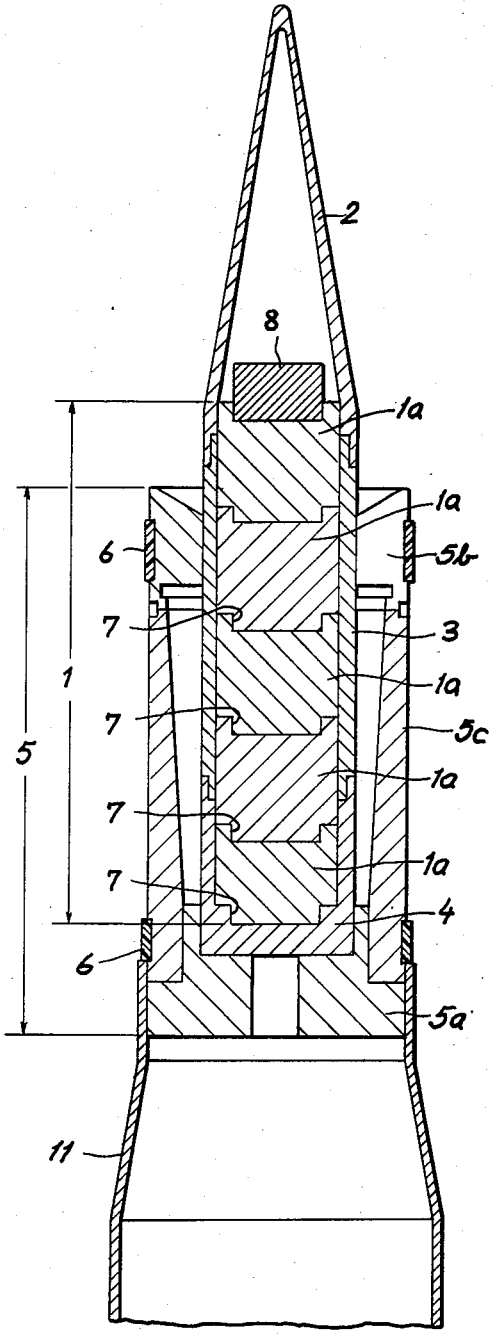
FIG. 1 shows a subcaliber inertial projectile with a partial core stack in longitudinal cross section.

The inertial projectile according to FIG. 1 with its sagittate projectile body, which comprises a throughgoing stack 1 of partial cores 1*a* surrounded by a thin-walled ballistic cap 2, a thin-walled casing 3 and a reinforced bottom 4, is armed with a segment-shaped propulsion cage 5 of a drive bottom 5*a*, front part 5*b* and a sleeve 5*c*. To maintain the transport integrity, the segments of the front part and of the drive bottom are each held together by an easily destructible synthetic-resin ring 6.

The partial cores 1*a* are composed of cylindrical bodies which are centered by outwardly lying collars and are fixed by means of the casing 3. In the partial core 1*a* turned toward the projectile cap 2 there is seated a harder insert core 8 whose diameter corresponds to that of the collar 7 but has a greater height than that of the collar 7.

Both the partial cores 1a and the insert core 8 have, facing in the firing direction, sharp cutting rims or edges.

Figure 2:
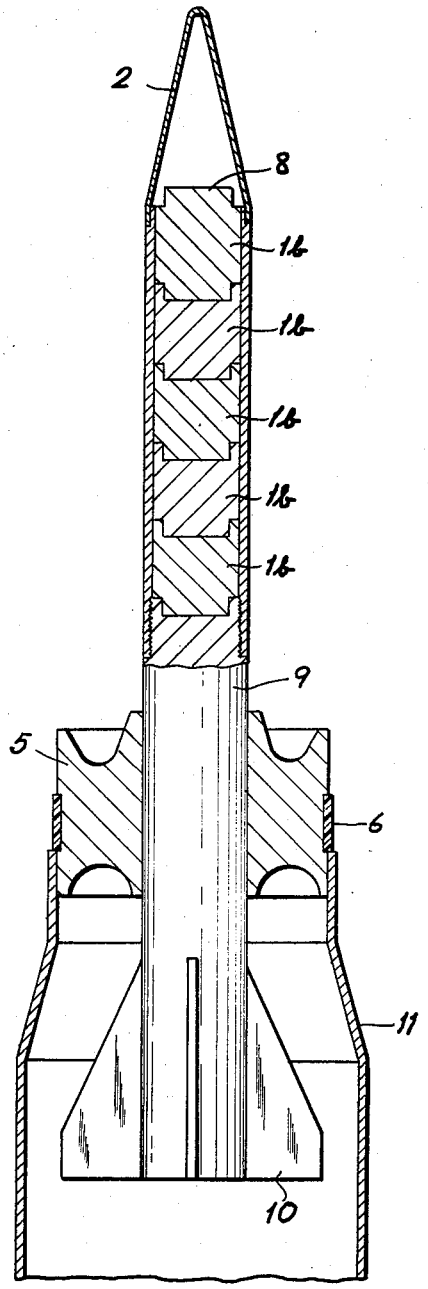
FIG. 2 shows a fin-stabilized inertial projectile with a main core and a stack of forecores.

With inertial projectiles according to FIG. 2, the rearward projectile half is occupied by a main core 9 which is provided with a stack 1 of a total of five forecores 1*b* centered one relative to another by outwardly lying collars 7. The forecores 1*b* are fixed by a thin-walled casing 3 and above by a cap 2.

On the periphery of the main core 9, which is provided with a screw thread, is seated the segmented propelling cage 5 held together by a synthetic-resin ring 6. Rearwardly the tail assembly 10 is seated on the main core 9. The propellant-charge-containing shell 11 is advantageously fastened on the periphery of the propellant cage 5.

Figure 3:
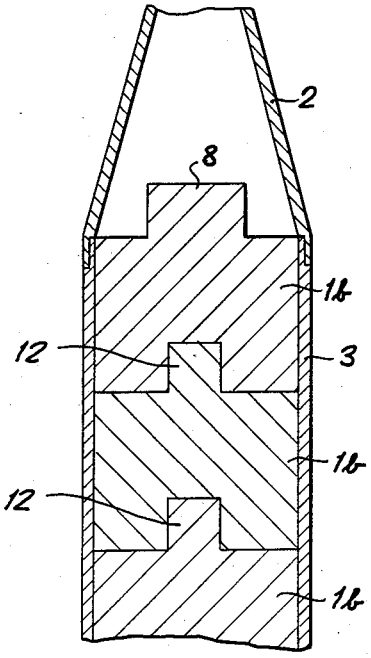
FIG. 3 shows a detail of an inertial projectile in which the forecores are centered by central pins and are fixed by a thin-walled casing.

In the detail showing of FIG. 3, a projectile construction similar to that of FIG. 2 has been illustrated in which, in place of the collars, comparatively thin and easily breakable central pins 12 are provided as the only centering means. In the forward-most forecore there is no inset core, as shown in FIG. 1, but a component part of the forecore 1*b* projects to form the boss 8. The forecores 1*b* are, for the purpose of fixing the entire projectile, enclosed in a thin-walled comparatively light casing connected to the cap 2. The latter casing is intentionally so that thin and light that it fulfills its holding function only until impact of the projectile. This is of great benefit to the forecores 1*a*, 1*b* and also the main core 9, because they retain a largest possible diameter which not only optimizes the projectile weight but due to the increased pitching or tipping moment also favors the burrowing of the cutting edges of the forecores 1b into the armored wall.

Figure 4:
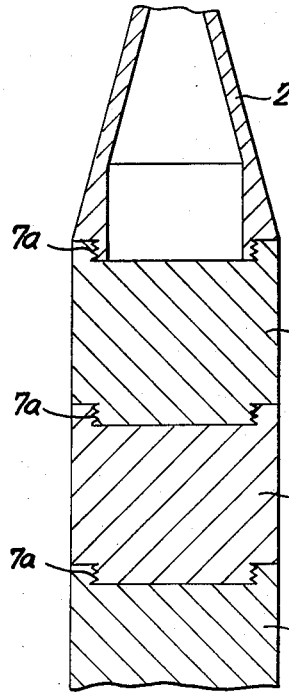
FIG. 4 illustrates a detail of an impact projectile with a stack of forecores which are centered by outwardly lying collars.

In FIG. 4 the projectile construction is similar to that of FIG. 1 except that the outwardly lying collars 7*a* are provided with threads so that the forecores 1*b* at the expense of the completely eliminated casing can attain a diamter up to that of the subcaliber. It is self-understood that the casing 3 can remain as part of the projectile construction.

Figure 6:
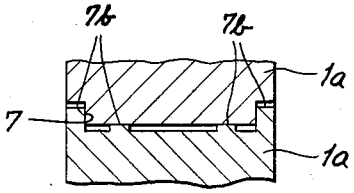
FIG. 6 represents a detail of an impact projectile with outwardly lying collars with point-shaped or line-shaped contact.
Figure 5:
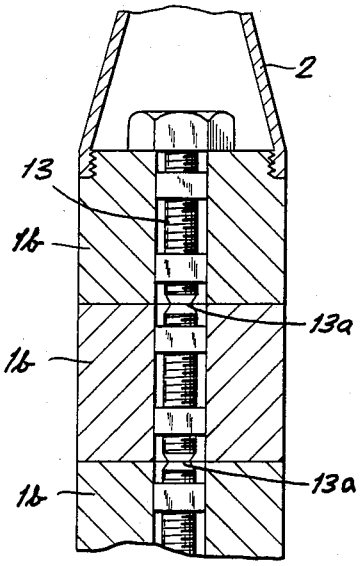
FIG. 5 depicts a detail of an impact projectile with a stack whose forecores are centered by means of a common throughgoing fastening screw.

According to FIG. 5, the stack 1 is held together by a central throughgoing fastening screw 13 whereby the screw in the region of the separating joints of successively abutting forecores 1*b* is provided with preset breaking zones 13*a*. For the impact impulse to be transmitted from one to another forecore only possibly diminshed, it is advantageous to modify the collars 7 and 7*a* in detail so that between the neighboring forecores 1*b* are provided only point- or line-shaped contacts which largely absorb the impact impulse by deformation. FIG. 6 shows one such separation joint between neighboring line-forming contacts 7*b* provided with an outwardly lying collar 7.

The operation is as follows:

When, after firing, the inertial projectile leaves the barrel, the synthetic-resin rings 6, which connect the propulsion cage segments together, no longer withstand the dynamic pressure of the counterflowing air and tear so that the segments can release from the projectile. The projectile of FIG. 1 is a spin-stabilized projectile which preferably at the drive bottom 5*a* or also in the region of the rearward synthetic-resin ring has a spin-stabilizing guide ring. The fin-stabilized projectile flies, on casting off of the propulsion cage 5, with the stabilizing tail assembly to the target. The impact projectile consisting only of partial cores 1*a* according to FIG. 1 is significant for use with such targets as are comprised of a number of similar amored walls stacked one behind the other which thus are so-called multiple targets. When an impact projectile according to FIG. 1 encounters such a multiple target, the ballistic cap 2 first peels off so that core after core 1a is freed to penetrate each subsequent armor plate. This is helped by the high flight speed and the comparatively high projectile weight but also by the sharp-edged cutting rims and finally the penetrating force which is largely maintained even for the following partial cores 1*a* so that each partial core 1*a* penetrates one of the armor plates located behind another.

The impact projector according to FIG. 2 is designed to attack targets which have pre-armoring of a plurality of similar armor walls and a main armoring which itself is fabricated not only from harder, but also from thicker-walled steel. With the forecores 1*b* the pre-armoring is penetrated piece by piece so that the main core 9 only has to penetrate the main armoring.

Figure 7:
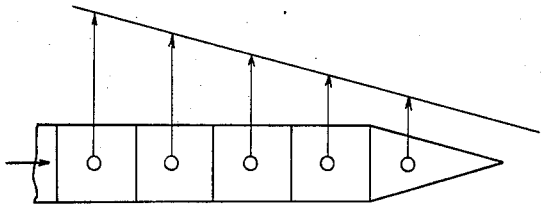
FIG. 7 shows the sliding forces on an impact projectile upon oblique impact.
Figure 8:
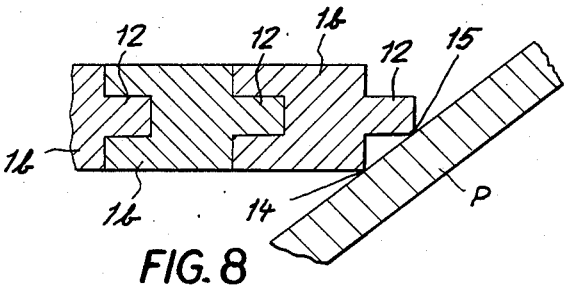
FIG. 8 illustrates a two-part cutting edge on a partial or forecore.

Upon oblique impact, not only the sharp-edged cutting rims of each individual forecore 1b biting into the walls, but also the inset core 8 or the pins 12, which are provided with a cutting edge, limit slipping of the core from the target wall. This double grip 14 and 15 upon biting into the armored wall P is illustrated in FIG. 8. Upon oblique impact, there arises yet another problem solved by the invention. The force, with which the successive partial cores and forecores 1a and 1b encounter the bombarded location, is of different magnitude depending upon the target object, but at least sufficiently large that the stack 1 collapses even upon contact of the leading core. To achieve a controlled dismantling of the stack 1, it is necessary to dimension the collars 7 and pins 12 in correspondence to the lateral shear force that with the increase in sheer force from core to core the fits become tighter. (See FIG. 7.) This can be necessary from the projectile tip to the rear as well as from the projectile bottom to the front. In any case, the centering means, such as collars 7, pins 12 and fastening screws 13, tear away from the impact so that it does not stand in the way of the penetrating cores 1*a* and 1*b*.

Independently of the controlled stack disassembly by the tolerancing of the centering means, it can be necessary, in spacing the impact from one core to another, to begin with a joint of the centering means of the first core with a reduced play and to end at the last core with the greatest play. A contribution to the improvement in the shock absorption can be made also by the selection of the material of the cores alone or in combination with the joint play.

The forecores 1*b* which are assembled into a stack 1 are, as to their outer configuration, so standardized that they are interchangeable among one another. Thus they can differ as to weight, hardness or sharpness of the cutting edges with predetermined characteristics. The easily releasable connection of the forecores 1*b* of a stack 1 makes it possible to associate individual forecores 1*b* or entire stacks 1 interchangeably with the main core 9, without dismounting or reworking the drive cage 5 or the tail assembly 10 or the propellant. Thus the newly developed impact projectile can be accommodated to the new target objects so well that the latter can be attacked effectively.

Finally, the impact projectile can be used as a full-caliber projectile which is spin-stabilized. The spin transfer means can be provided between the projectile casing and the cores.

We claim:

1. A weapon round effective for multiple and structured targets, comprising:

a propellant-containing casing and a subcaliber sagittate inertial impact projectile received in said casing and adapted to be fired through a barrel of a weapon, said subcaliber projectile comprising:

an elongated projectile body;

means on said body releasable therefrom and adapted to form a drive cage in said barrel;

means forming a tip at a forward end of said body; and flight-path stabilizing means on a rear end of said body for directing said body toward a target, said body comprising:

an armor-breaking stack of a multiplicity of partial cores each provided with a respective cutting edge turned toward said forward end, said cores all being composed of metal and having a cylindrical configuration, all of said cores being of equal diameter and having planar separating surfaces along which the respective cutting edges are formed, said cutting edges being sharp circular edges limiting glancing off upon inclined impact of said cores with the target; and means for centering said partial cores relative to one another and in successively abutting relationship, and for fixing said cores together to enable separation of said cores from said stack on impact of said projectile with said target whereby said cores successively pierce successively inwardly lying layers of the armor of said target, and for replacement of said cores in said stack, said means for centering and fixing said partial cores including a thin-walled soft casing surrounding said stack, and a cylindrical boss of each core received within a thin outer collar of an adjacent core, said collars carrying said cutting edges.

2. The weapon round defined in claim 1 wherein said stack occupies a forward half of said body and said body further comprises a main core extending over the rearward half of said body.

3. The weapon round defined in claim 1 or claim 2 wherein the partial cores individually and as the entire stack are replaceable in said body to correspond in size, number and material to requirements for the target to be attacked.

4. The weapon round defined in claim 1, further comprising a thread connecting each of said collars to a respective boss extending rearwardly from a partial core ahead of the core carrying each collar.

5. The weapon round defined in claim 1 or claim 2 wherein the centering and fixing means is provided with tolerances enabling a controlled core-by-core dismantling of the stack upon inclined impact of said projectile with a target.

* * * * *